US006413002B1

(12) United States Patent
Delaine, Jr.

(10) Patent No.: US 6,413,002 B1
(45) Date of Patent: Jul. 2, 2002

(54) AQUA BROOM

(76) Inventor: Phillip Delaine, Jr., 28 Joco Dr., Tyngsboro, MA (US) 01879

( * ) Notice: Subject to any disclaimer, the term of this patent is extended or adjusted under 35 U.S.C. 154(b) by 0 days.

(21) Appl. No.: 09/205,747

(22) Filed: Dec. 4, 1998

Related U.S. Application Data

(60) Provisional application No. 60/093,321, filed on Jul. 20, 1998.

(51) Int. Cl.[7] ..... A46B 11/06

(52) U.S. Cl. ..... 401/289; 401/268; 401/282; 401/285

(58) Field of Search ..... 401/282, 284, 401/285, 286, 289, 137, 138, 268, 136; 239/289, 578, 587.1, 754, 722; 15/24, 29, 50.1, 50.2, 50.3, 51, 320, 321, 97.1

(56) References Cited

U.S. PATENT DOCUMENTS

| | | | | | |
|---|---|---|---|---|---|
| 180,985 | A | * | 8/1876 | Birtwistle | |
| 361,584 | A | * | 4/1887 | Flower | |
| 371,515 | A | * | 10/1887 | Nowotny | |
| 380,345 | A | * | 4/1888 | Pearce | |
| 417,349 | A | * | 12/1889 | Weitzel | |
| 539,313 | A | * | 5/1895 | Thierry et al. | |
| 623,616 | A | * | 4/1899 | Mullins | |
| 828,705 | A | * | 8/1906 | Bode | |
| 854,151 | A | * | 5/1907 | Deasy | |
| 972,898 | A | * | 10/1910 | Montgomery | |
| 1,118,774 | A | * | 11/1914 | Hunter | |
| 1,523,823 | A | * | 1/1925 | Matta | |
| 2,595,933 | A | | 5/1952 | Gilbertsen | 299/56 |
| 2,641,507 | A | * | 6/1953 | McGregor | |
| 2,746,072 | A | * | 5/1956 | Lumpkin | 239/754 |
| 3,083,916 | A | * | 4/1963 | Neel | |
| 3,113,335 | A | * | 12/1963 | Baicker | |
| 3,150,394 | A | * | 9/1964 | Sauers | |
| 3,726,602 | A | * | 4/1973 | Rosocha | 401/196 |
| 3,748,678 | A | * | 7/1973 | Ballou | 15/24 |
| 3,822,069 | A | * | 7/1974 | Petsch | |
| 3,937,399 | A | * | 2/1976 | Halley | |
| 4,095,746 | A | * | 6/1978 | Anderberg et al. | |
| 4,167,349 | A | * | 9/1979 | Testa | 401/144 |
| 4,200,236 | A | * | 4/1980 | Briar | 239/754 |
| 4,271,617 | A | * | 6/1981 | Yoshizawa | |

(List continued on next page.)

FOREIGN PATENT DOCUMENTS

| | | | | |
|---|---|---|---|---|
| DE | 77 36 700 | | 4/1978 | |
| FR | 319119 | * | 2/1902 | 401/286 |
| FR | 2 665 650 | | 2/1992 | |
| GB | 15257 | * | 7/1908 | 401/137 |
| GB | 860474 | * | 2/1961 | 401/137 |
| GB | 1160989 | * | 8/1969 | 401/137 |
| IT | 582329 | * | 9/1958 | 401/137 |

*Primary Examiner*—Gregory Huson
*Assistant Examiner*—Khoal Huynh
(74) *Attorney, Agent, or Firm*—Bromberg & Sunstein LLP

(57) ABSTRACT

A device for sweeping a substantially horizontal surface is provided which includes a broom having a handle and a head, a valve disposed on the device, and a spray bar disposed on the head for directionally spraying a liquid that is supplied to the valve, wherein the valve regulates the pressure of liquid sprayed by the spray bar. The liquid may be water from a common garden hose. In embodiments, the spray bar is movably positioned on the head. In embodiments, the device may further include a reservoir for holding an agent for treating the horizontal surface. In embodiments, the valve is spring-loaded and/or hand-controlled. The device may include tubing between the valve and the spray bar. The tubing may be positioned internal to the handle or external to the handle. The handle may be used to convey liquid from the valve to the spray bar. In an embodiment, the head may include water channels. The spray bar may be made integral to the head. The spray bar may take a variety of shapes, including elliptical, u-shaped and straight shapes.

18 Claims, 12 Drawing Sheets

U.S. PATENT DOCUMENTS 4,340,179 A * 7/1982 Knapp
4,580,726 A * 4/1986 Unger
4,895,179 A 1/1990 Hart ..... 134/172
5,007,753 A * 4/1991 England, Jr. ..... 401/289
5,092,699 A * 3/1992 Silvenis ..... 401/21
5,333,337 A * 8/1994 Markley ..... 15/29
5,707,014 A * 1/1998 Chan et al. ..... 239/754
5,725,322 A * 3/1998 Evans
5,908,163 A * 6/1999 Wells
5,988,912 A * 11/1999 Chen ..... 401/137

* cited by examiner

AQUA BROOM

CROSS-REFERENCE TO RELATED APPLICATIONS

This application is based on U.S. Provisional Patent Application No. 60/093,321, filed Jul. 20, 1998, which is hereby incorporated by reference herein.

BACKGROUND OF THE INVENTION

1. Field of the Invention

This application relates to the field of cleaning implements, and more particularly to the field of brooms.

2. Description of Related Art

A conventional push broom is a device that is commonly used to clean floors. Such a push broom is shown in FIG. 1. The components of push broom may include a broom handle 1 and a broom head 3 with attached bristles 2. The cleaning action of the broom is provided by the user exerting a downward force on the handle 1 while pushing forward, which causes the bristles 2 attached to the broom head 3 to push loose debris on a surface, such as a floor, to another location. The user then lifts the broom head 3 slightly and pulls backward, such that the broom head 3 is repositioned to repeat the cleaning action.

One disadvantage, of the conventional push broom is that it usually takes several passes of the broom head to completely clean an area. For example, when attempting to sweep grass clippings off a concrete or asphalt surface, often the clippings partially adhere to the surface, which causes a rolling effect under the bristles as the bristles attempt to push the clippings away. The result is many of the clippings remain in the area just swept, which in turn requires the user to repeat the sweeping action in the same area several times in order to remove all of the debris. The need for such repetition can also be observed when sweeping sand, dirt or small rocks on a similar surface. Even with these flaws the conventional push broom is the device that is most commonly used to clean floors or other similar surfaces.

Debris can be removed from a floor surface by water pressure exerted by a hose nozzle attached to a common garden hose. An example of such a hose nozzle is illustrated in FIG. 11. The hose nozzle is a hand held device and, when activated while pointed at the floor, requires several horizontal and vertical motions in order to remove debris. The disadvantage of this method is the significant amount of time and effort required to clean a large area. This method of cleaning can be ineffective if the debris content is high, partially stuck to the floor, relatively large or relatively heavy. In addition, the remaining water on the floor surface may cause puddling and require excessively long drying times.

Wheel-mounted spray systems are also known. These devices are generally called water brooms. An example of such a broom is shown in FIG. 12. This type of device uses the force of water to lift and push debris. Given the spray jets' close proximity to the floor, these devices can be effective when attempting to remove loose and relatively small debris from a floor. However, if the debris is larger or heavier, several cleaning passes may be required. Its effectiveness can be greatly enhanced when using water pressure above 75 PSI. The advantage of this art is that it can sweep an area faster than the hose nozzle method mentioned above. The disadvantages of this art are many: 1) with normal household water pressures of 40 to 75 PSI these devices are marginally effective in removing larger stones, gravel and other similar debris, 2) with normal water pressure, these devices have limited abrasive cleaning characteristics, and mechanical pushing ability, 3) a pressure boosting device may be required in order to achieve the desired cleaning effectiveness, 4) with higher water pressures, the high misting effect can damage surfaces such as drywall in garages, 5) the cleaning action is provided only by the force of water which may be inappropriate in certain areas of a floor, 6) the water and debris on the floor can only be moved and directed with the spray of additional water, 7) as water pools in front of the device the pushing effectiveness of the water spray diminishes, thus allowing water and debris to flow around and behind the device, 8) higher amounts of water are required in order to clean a given surface, 9) the floor surface can remain very wet after use, 10) significant puddling can occur after use, 11) the floor drying time may be excessive due to the high amount of water remaining on the floor, 12) the remaining water on the floor may need to be removed by a push broom or squeegee, and 13) the corrosive effects of water, salt and grime, will cause the wheels or castors to deteriorate and become inoperable over time. These reasons, collectively or in various combinations, may explain why this type of device has had limited commercial success.

The water broom art and similar art are documented in several United States patents, the disclosures of which are incorporated by reference herein, including: U.S. Pat. Nos. 3,931,931, 4,022,382, 4,083,495, 4,095,746, 4,930,706, Des. 243,610, Des. 244,532, Des. 250,826, and Des. 277, 499.

Brush and water technology have been combined. FIG. 13 shows an example of such a device. Pictured is a model 8540 cleaning device manufactured by Mr. LongArm, Inc. This device features a water cut-off turn valve 100, with an exploded view 101, and a brush head 104, with an exploded view of the bottom 105. This device also features an extendable broom handle 102 which is adjusted at 103.

FIG. 15 shows a flow chart that lists the procedures for the brush device's use. Referring to FIGS. 13 and 15, and starting at step 130, the user connects a garden hose to the water service and the brush device at 100. The user checks that the water cut-off valve 101 is turned off, at step 131. The user turns on the water service, at step 132. While holding the broom handle 102, the user positions the brush head 104 near the surface to be cleaned, at step 133. At step 134, the user turns the valve control 101 such that water passes through the valve 101, the broom handle 102 and emerges from a hole 107 at the bottom of the brush head 105. The user pushes the brush head 104 onto the surface to be cleaned, at step 135. At step 136, the user induces a back and forth action on the broom handle 102 such that the brush head 104 scrubs the desired surface. At step 137, if additional cleaning is required, step 136 is repeated. If not, at step 138, the user removes the brush head 104 from the surface, turns off the water cut-off valve 101 and stops. This device is very useful when cleaning surfaces such as walls, vinyl siding, cars, tires and other sloping or substantially vertical surfaces. The general release of water near the brush bristles and the scrubbing action is very effective for these surfaces. The issue of where the water goes is generally not a problem because the water falls and drips off the item being cleaned. However, this type of device is not appropriate for cleaning floors or other similar horizontal surfaces. When used on a floor, the water emerges on the floor in an arbitrary manner. There is no directional control of the water from the brush head, which makes this device difficult to use in floor sweeping applications. In addition, the lack of easy control of the water flow at the cut-off valve adds another layer of difficulty and complexity to the operation on such surfaces. This device is simply not practical for cleaning floors. It should be noted that the five uses cited by the manufacturer's accompanying brochure picture sloping or substantially vertical surface applications. The applications cited are: a user cleaning a house window, the back window of a car minivan, a house awning, the front of a boat, and the vinyl siding of a house. There are no horizontal floor applications cited.

Accordingly, a need exists for a device that overcomes the drawbacks of the devices described above and that is practical for cleaning floors and other horizontal surfaces.

SUMMARY OF THE INVENTION

The invention merges the push broom technology together with the water broom technology. The result is a highly effective and unique floor cleaning tool.

Provided herein is a device for sweeping a substantially horizontal surface, which includes a broom having a handle and a head, a valve disposed on the device, and a spray bar disposed on the head for directionally spraying a liquid that is supplied to the valve, wherein the valve regulates the pressure of liquid sprayed by the spray bar. The liquid may be water from a common garden hose. In embodiments, the spray bar is movably positioned on the head. In embodiments, the device may further include a reservoir for holding an agent for treating the horizontal surface. The treating agent may be a soap, a solvent, a stain, a cleaning liquid, a paint, a wax, or any other known treating agent. The device may include a filter for filtering particles from the treating agent. In embodiments, the valve is spring-loaded and/or hand-controlled. The device may include tubing between the valve and the spray bar. The tubing may be positioned internal to the handle or external to the handle. The handle may be used to convey liquid from the valve to the spray bar. In an embodiment, the head may include water channels. The spray bar may be made integral to the head. The spray bar may take a variety of shapes, including elliptical, u-shaped and straight shapes.

Provided herein is also a method of using a device for cleaning a substantially horizontal surface, including providing a broom having a handle and a head, positioning a valve on the handle, positioning a spray bar on the head for spraying a liquid that is supplied to the valve, providing a supply of cleaning liquid to the valve, opening the valve and sweeping the surface with the broom while spraying the surface with the spray bar. The methods may include adjusting the position of the spray bar according to the nature of the cleaning task.

Provided herein is further a device for sweeping a substantially horizontal surface, which may include a broom having a handle and a head, a spring-loaded, hand-controlled valve disposed on the handle, a spray bar disposed on the head for directionally spraying a liquid that is supplied to the valve, wherein the valve regulates the pressure of liquid sprayed by the spray bar and wherein the spray bar is movably positioned on the head, and a tube, having a lumen, for delivering the liquid from the valve to the spray bar. The device may further include a reservoir for holding an agent for treating the horizontal surface. The tube may be positioned internal to the handle. The head may include water channels. The spray bar may be made integral to the head.

DETAILED DESCRIPTION OF THE PREFERRED EMBODIMENT(S)

Figure 1:
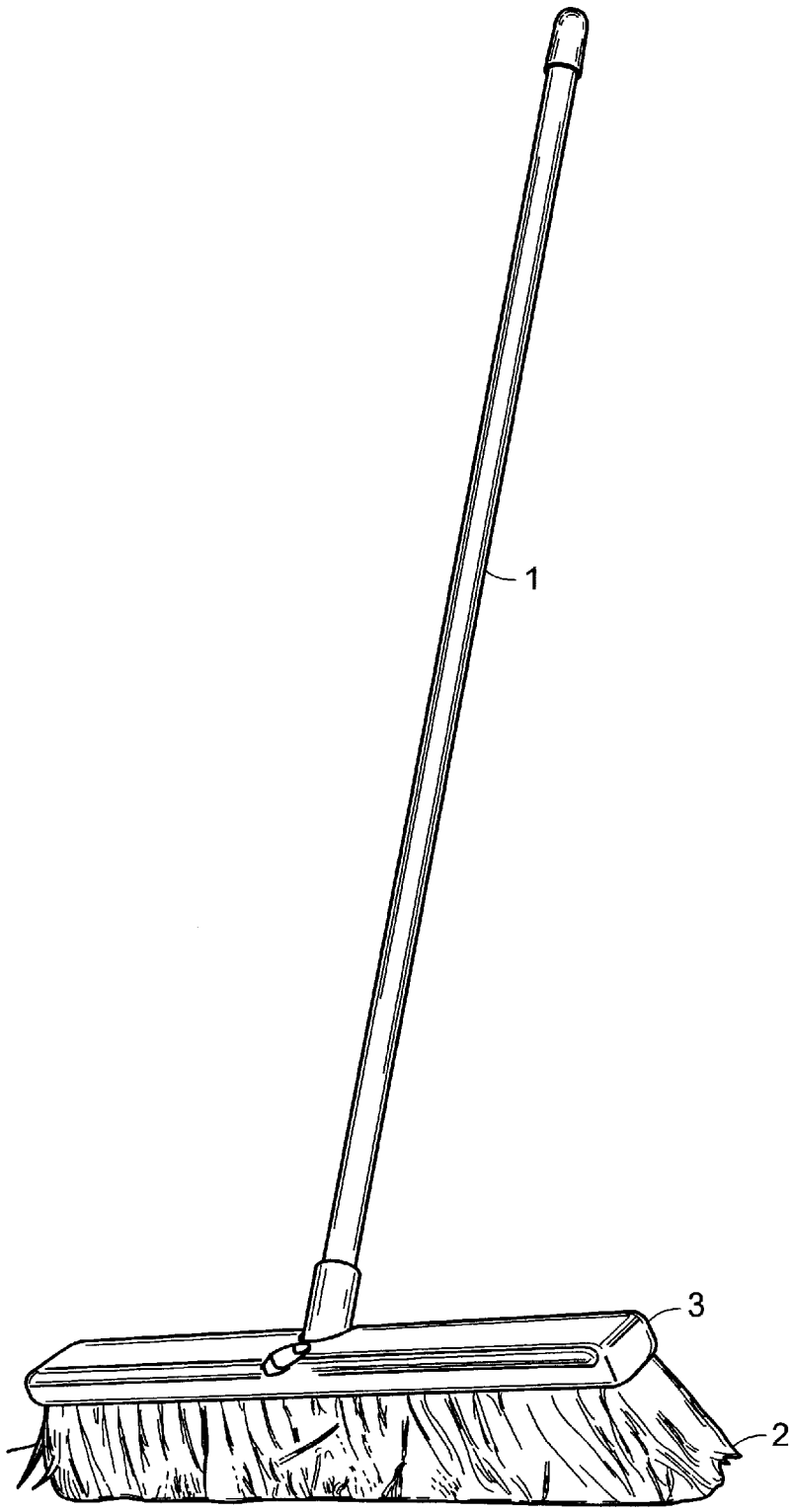
FIG. 1 depicts a conventional push broom.
Figure 2:
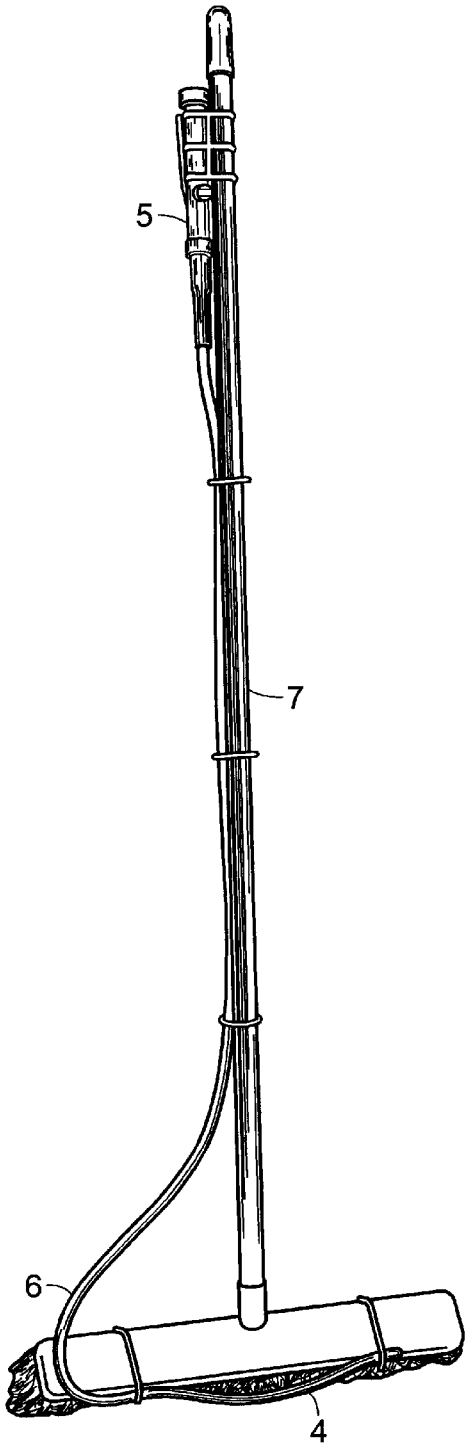
FIG. 2 depicts an embodiment of the invention, including a water spray bar and a spring-loaded hand-controlled valve.

The invention herein provides a push broom with a water spray bar 4 and a spring-loaded hand-controlled valve 5 as shown in FIG. 2. A common garden hose is connected to the spring-loaded valve at a valve entry point 9, shown in FIG. 3. The valve 8 may be used to regulate the flow of water from the hose to a spray bar 26, shown in FIG. 4. Referring again to FIG. 2, the water may be conducted from the valve 5 to the spray bar 26 via tubing 6. When the user squeezes a valve lever 10 toward the body of the valve 8, water is enabled through the valve 5 and tubing 6 to the spray bar 26. When the user releases the valve lever 10, the valve 5 is closed, which stops the water flow to the spray bar 26.

Figure 4:
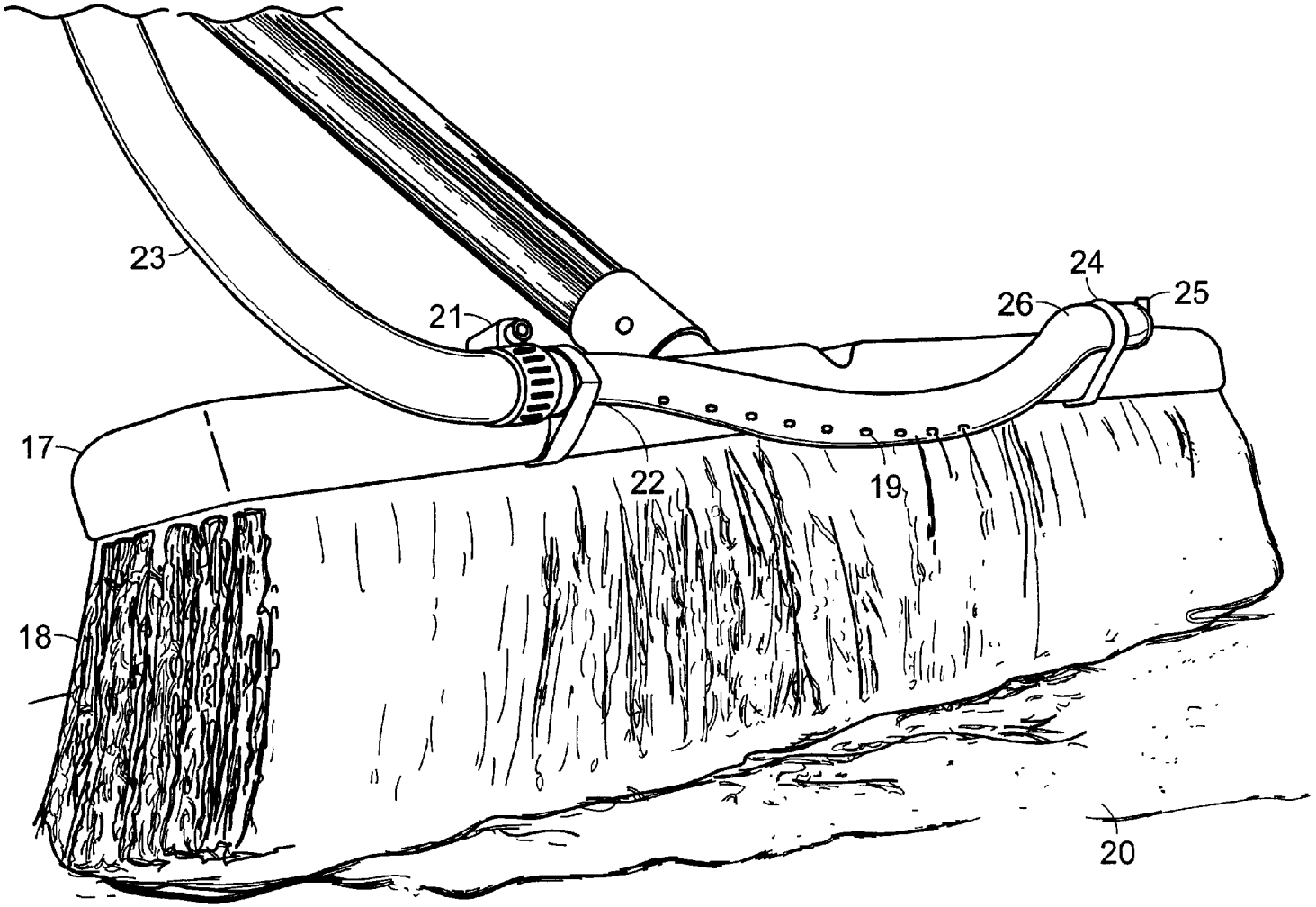
FIG. 4 depicts a more detailed view of the water spray bar of the embodiment of FIG. 2.

Referring to FIG. 4, the spray bar 26 contains several holes 19 and is positioned in front of the broom head 17 such that when water pressure is applied, strong jets of water emerge from the holes 19, which pound and buffet a surface 20, such as a floor surface, in front of bristles 18 of the broom head 17.

The push broom is provided with a directional water jet spray from the spray bar 26, for dislodging and suspending debris prior to the sweeping action of the broom's bristles 18. Most, if not all, of the debris can be removed with a single sweeping pass.

Figure 14:
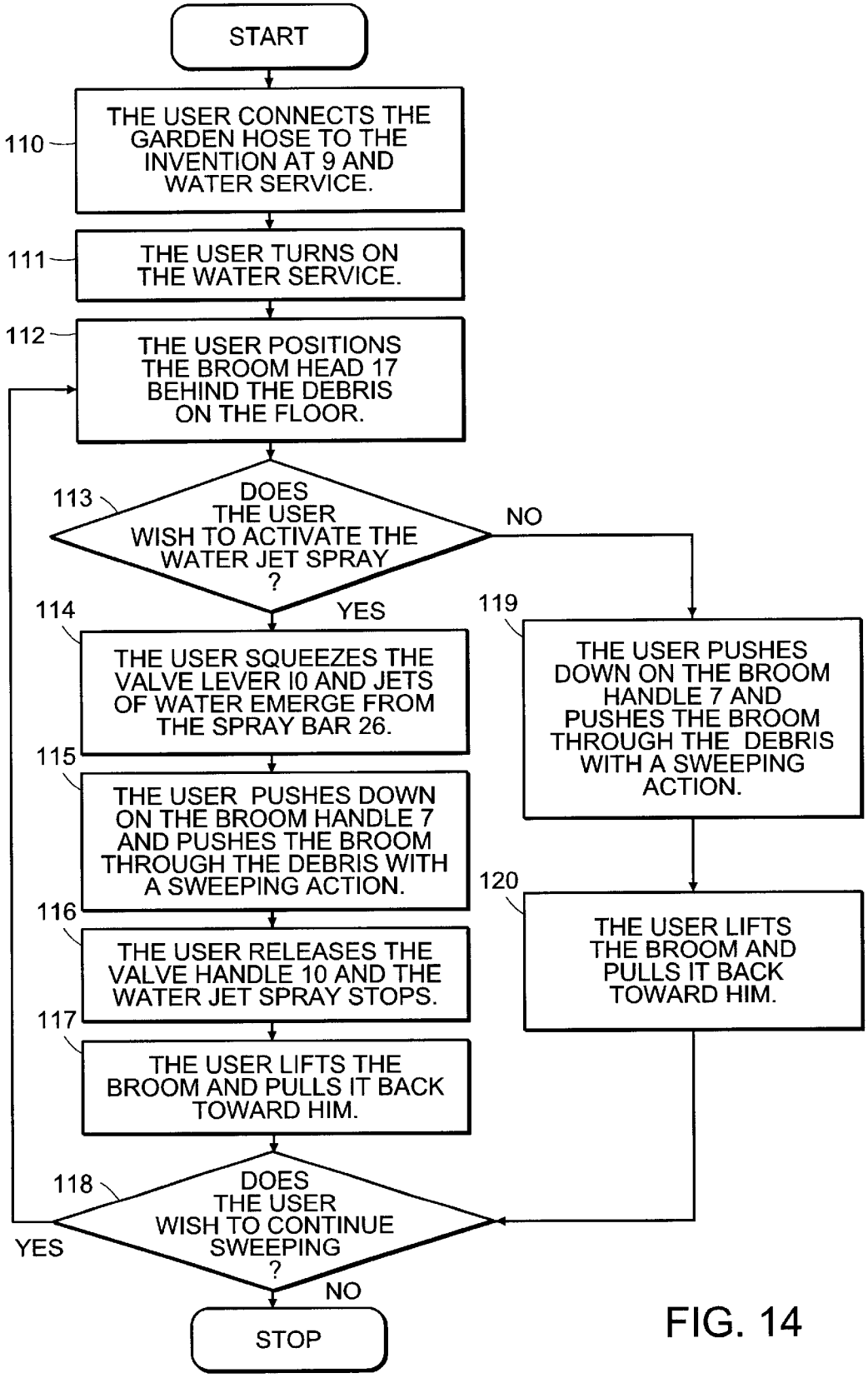
FIG. 14 is a flow chart that lists the procedures for use of an embodiment of the invention.
Figure 15:
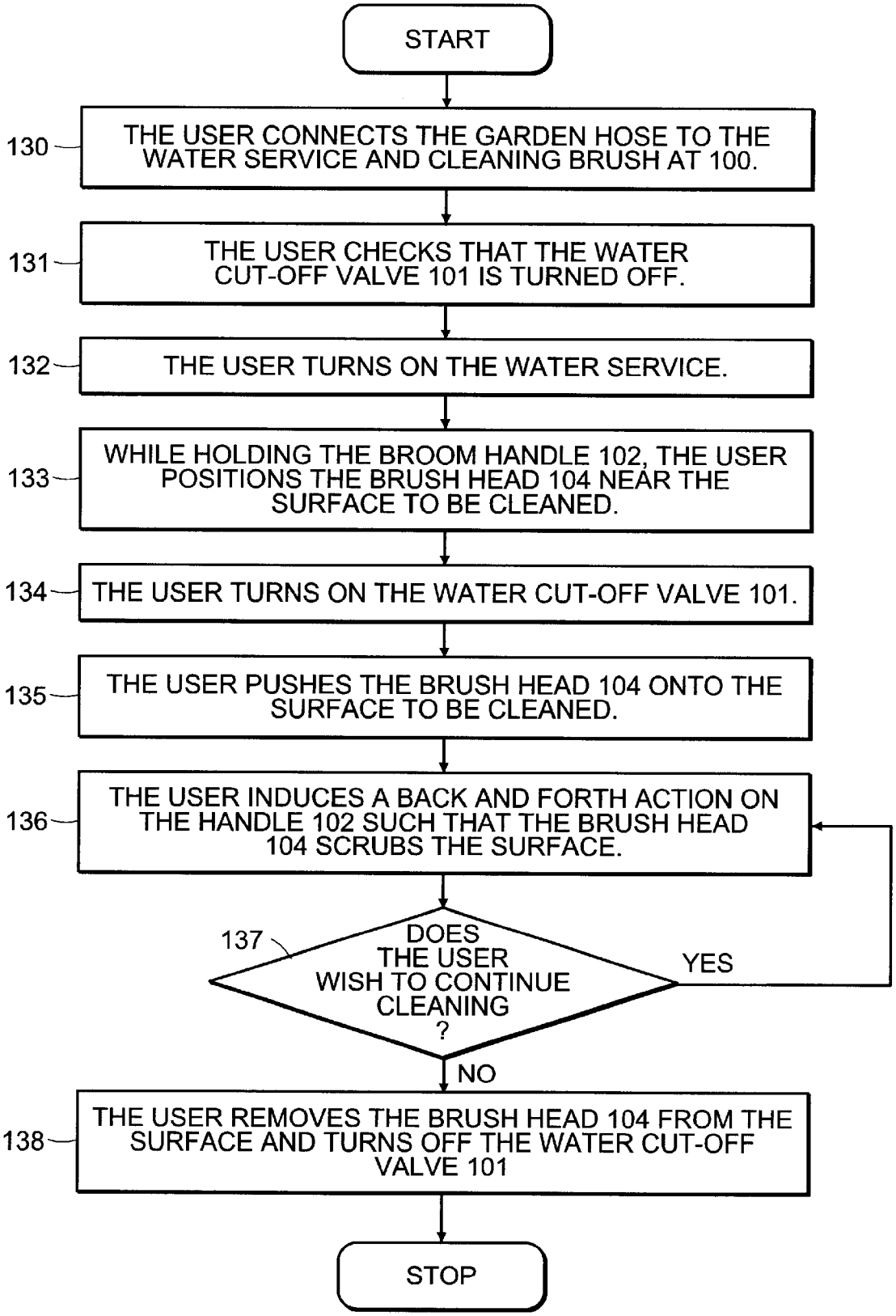
FIG. 15 is a flow chart that lists the procedures for the use of a conventional brush device.

FIG. 14 shows a flow chart that lists the procedures for the invention's use. Referring to FIG. 14 and starting at step 110, the user connects the garden hose to the invention at the valve entry point 9 and connects the hose to the water service. The user turns on the water service, at step 111. The user positions the broom head 17 behind the debris he or she wishes to move, at step 112. At step 113, the user decides whether or not to use to the water jet spray. At step 114, if the water jet spray is desired, the user squeezes the valve lever 10 and jets of water emerge from the spray bar 26. The user pushes downward on the broom handle 7 and pushes the broom through the debris area, at step 115. At the end of the user's extension, the user releases the valve lever 10 and the water jet spray stops, at step 116. The user lifts the broom, pulls the broom back toward him or her self, at step 117. At step 118, if the user needs to perform additional cleaning, the steps starting at step 112 can be repeated. If not, the user can stop. If at step 113 the user decides not to use the water jet spray, the user pushes downward on the broom handle 7 and pushes the broom through the debris area, at step 119. The user lifts the broom, pulls the broom back toward him or her self, at step 120. At step 118, if the user needs to perform additional cleaning, the steps starting at step 112 can be repeated. If not, the user can stop.

Figure 5:
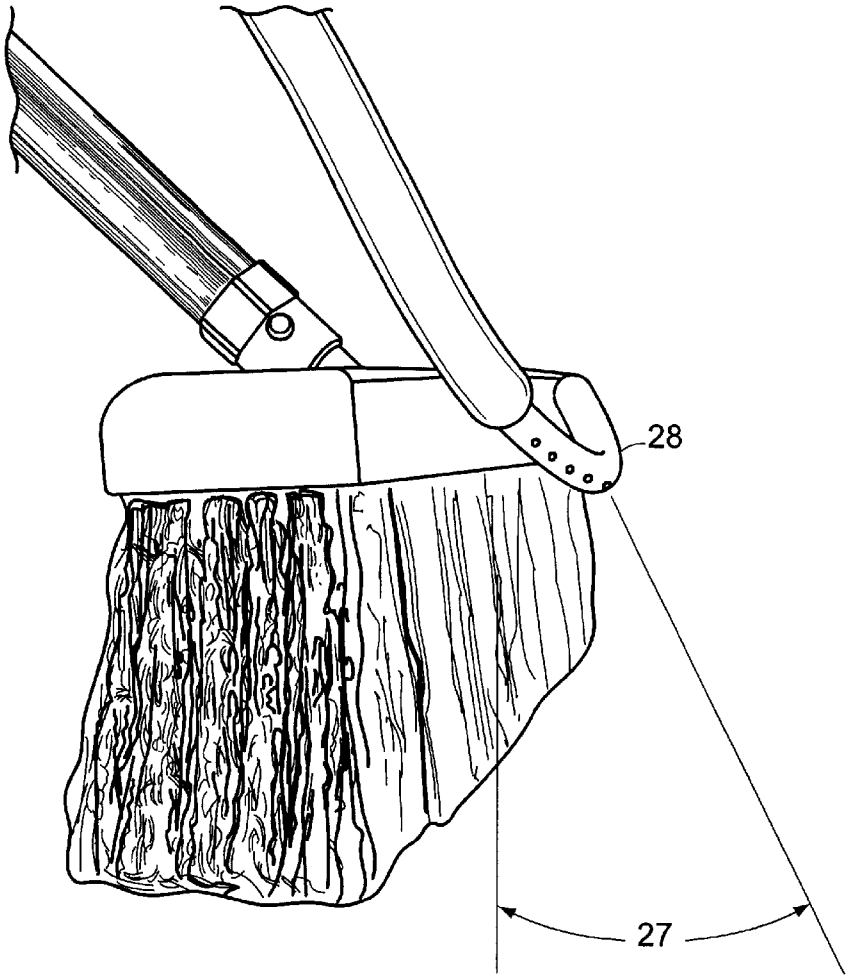
FIG. 5 illustrates the capability of changing the water spray attack angle by manually rotating the pitch of the spray bar.

Referring to FIG. 5, the invention has the advantage of allowing the user to change the water spray attack angle 27 on the floor by manually rotating the pitch of the spray bar 26. The ability to change the water attack angle 27 allows the user to match the effectiveness of the water jet spray with the type of debris that is being swept. Effective water attack angles may be in a wide variety of angles. In embodiment, water attack angles of between fifteen and forty-five degrees are available.

The invention has significant cleaning flexibility. This invention easily removes sand, dirt, grime, grass clippings, pine needles, saw dust, bark mulch, small rocks and any other similar debris from a floor surface. The combined forces of the water jet spray and the highly abrasive characteristics of the broom bristles can also remove debris stuck to the floor. The invention can clean very contaminated areas due to the broom bristles which can collectively push large amounts of debris and water. This invention is ideal for cleaning concrete, asphalt, steel, plastic, wood or other horizontal surfaces. These surfaces include; garage and basement floors, patio decks, street curb areas, truck beds (plastic or steel), sidewalks and any other surface where a water jet spray and sweeping action would be effective.

The invention works extremely well with normal household water pressures from 40 to 75 psi. Higher water pressures can be used, and, in some applications, may be desirable.

The invention gives the user excellent control over the amount of water used, and when not needed, the user can direct the water and/or debris with the broom bristle action alone. Because the broom bristles follow the water spray, the floor surfaces will only be damp and relatively quick to dry after the invention's use.

Figure 3:
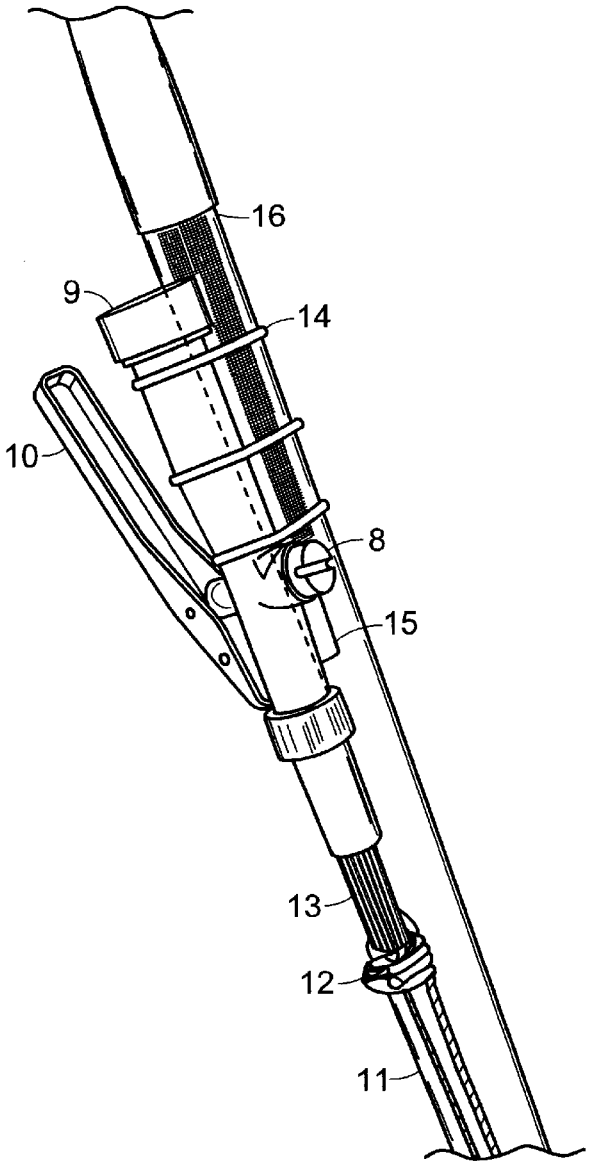
FIG. 3 depicts a more detailed view of the valve assembly of the embodiment of FIG. 2.

The invention shown in FIGS. 2, 3 and 4 may be constructed with the following materials. The valve 5 may be fabricated from a Sears Telescoping Shower Sprinkler, ID number [71]2169081. The spray bar 26 may be a Nelson model 1015 Rainshower® oscillator sprinkler. The spray bar 26 may be an aluminum, elliptically shaped ½" diameter tube, 11⅝" long, with 16 spray jets spaced approximately ½" apart. A band saw may be used to cut the Shower Sprinkler and Oscillator sprinkler so as to isolate the valve 5 and the spray bar 26, respectively. Both devices may be cut in a location allowing sufficient stems 13, 22 so that vinyl tubing and clamps 12, 21 can be attached. In addition, the elliptical sprinkler tube may include a plug 25 to prevent water from exiting the end of the sprinkler tube. The broom may be similar to that manufactured by O. Ceder with a 54"long broom handle and a broom head which measures approximately 17½" Wide×2½" Thick×4" High. The height includes a bristle length of 3". The tubing 11, 6, 23 may be made of ordinary clear ⅝" outer diameter×½" inner diameter vinyl tubing with a length sufficient to reach from the valve stem 13 to the spray bar stem 22, and the strength to withstand water pressure. The device may include straps 14, 24, which may be common ties made of plastic with sufficient strength to hold the various components in place. The clamps 12, 21 may be made of ordinary stainless steel sufficient to fix the vinyl tubing onto the valve stem 13 and spray bar stem 22. A piece of wood 15, 4½" Long×¼" Wide×¾" High, may be used as a spacer that allows for proper seating of the valve onto the broom handle 16.

Advanced manufacturing may allow different adaptations of the invention. The spring-loaded valve can be made to attach onto the broom handle via glue, screw, snap, clip, or clamp. The valve can be made as an integral part of the broom handle. The valve can be located on the broom head or another part of the handle. The spring-loaded valve can be made to actuate by a button, trigger or lever type mechanism. The valve can also be made to actuate by a mechanism that senses the downward or pushing force on the broom handle. The tubing can be placed inside of a hollow broom handle. The broom handle can be manufactured such that it passes the water from the valve to the broom head without vinyl or similar tubing. The broom head can be manufactured with water channels molded or built into the broom head. The broom head can be manufactured to receive water from the broom handle and pass it to the spray bar without the need of vinyl or similar tubing. The broom head can be manufactured such that the spray bar is an integral part of the broom head. The spray bar can be made of aluminum, plastic or other material. The spray bar can be manufactured in different shapes including elliptical, u-shaped or straight. The spray bar can be manufactured with varied lengths and number of spray jets. The spray bar can be manufactured to glue, screw, snap, clip, clamp or use some other means to attach to the broom head. The spray bar can be manufactured to swivel to different angles or be fixed to a particular angle. The spray jets can be manufactured with various diameters and shapes. The size and quantity of spray jets can be varied to maintain sufficient water pressure and force in front of the broom head. All of these adaptations, or similar adaptations, practice the invention herein.

All of the components, the valve, the tubing, the spray bar and the clamps can be manufactured such that they form a kit so that a user can change a common push broom into the invention.

Figure 6:
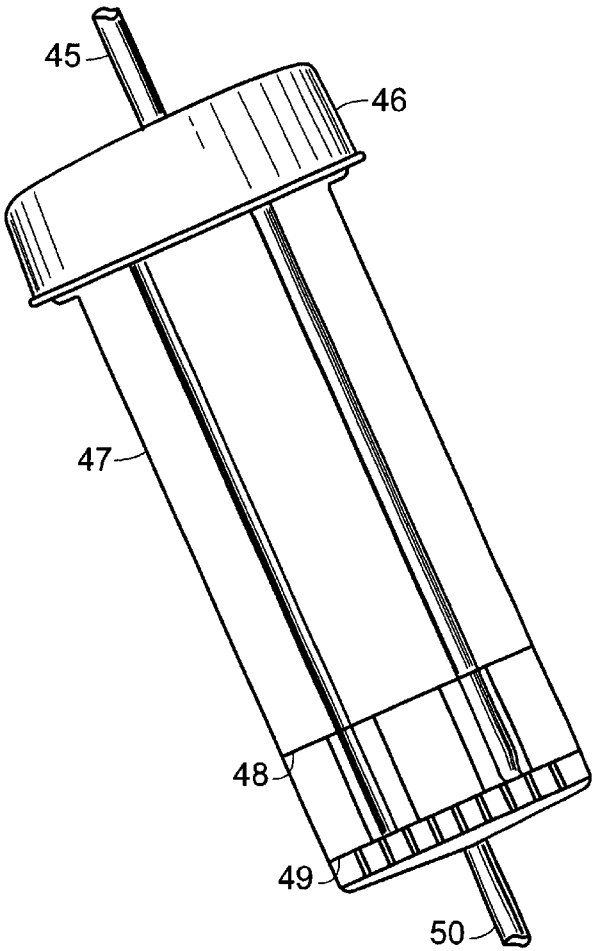
FIG. 6 illustrates a reservoir that can be positioned mid-handle or on the broom head in an embodiment of the invention.

FIG. 6 shows a reservoir 47 that can be positioned on the broom handle or on the broom head. This feature allows the user to dispense a soap and water solution that can then be scrubbed into a surface using the broom bristles. The turbulence of the water as it passes through the reservoir 47 can be used to dissolve the soap agent resting on top of a platform 48. Other agents can be used including a wax or stain. The agent can be in the form of tablets or granules. The agent can be made to dissolve slowly and with sufficient strength so that the user has sufficient effective spray time for the application. A screen filter 49 can be positioned at the bottom of the reservoir to prohibit small particles of agent from plugging the holes in the spray bar. The reservoir may be opened or disassembled at 46 in order to fill it with the desired agent, and when closed or reassembled, a watertight compartment is formed that can withstand water pressure. The input stem 45 can be connected to the valve stem 13 via vinyl tubing. The output stem 50 can be connected to the spray bar 26 via vinyl tubing. Clamping as previously discussed can be used to attach the vinyl tubing to the stems.

The reservoir may be fixed to the broom handle by clamp, straps, screws, nails or other attachment means or integrated into the handle or broom head. The reservoir adds an additional cleaning feature while maintaining the simplicity of the invention.

Figure 7A:
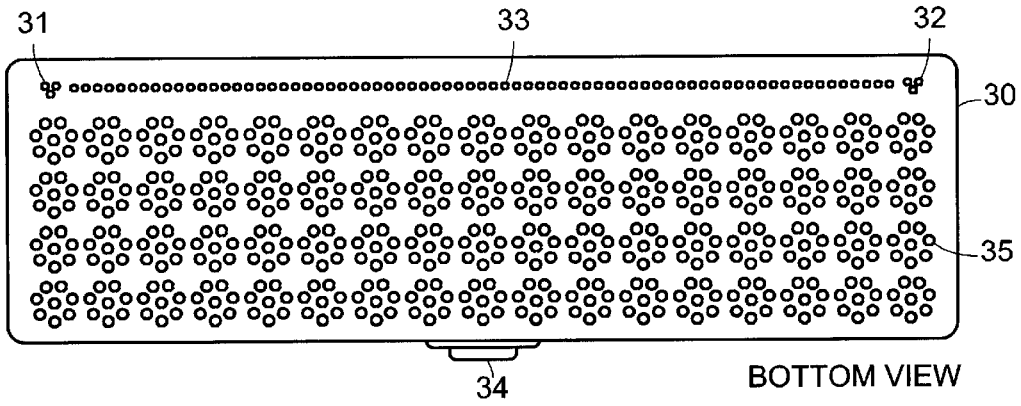
FIG. 7 depicts a bottom view of a broom head with an integrated spray bar.
Figure 7B:
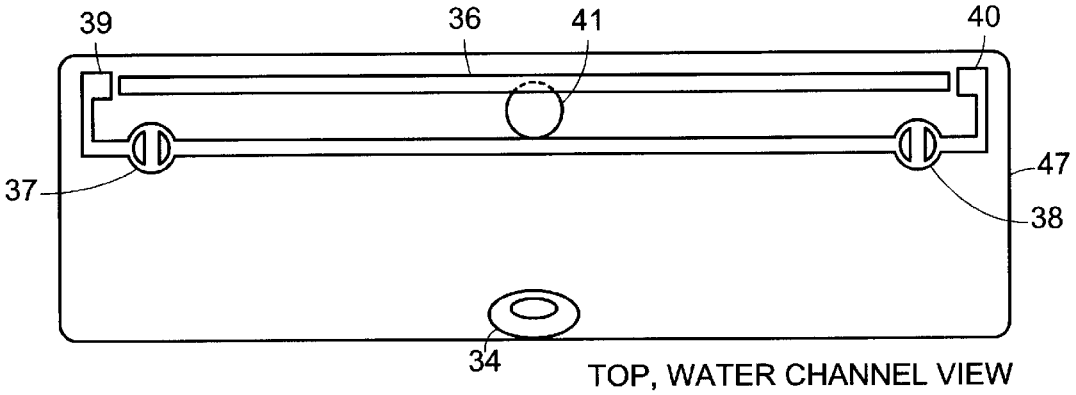
Figure 7C:
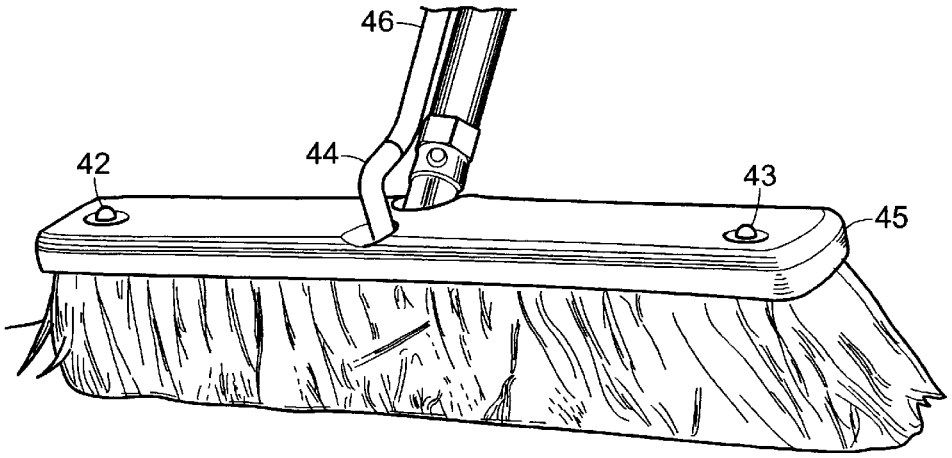

FIG. 7 shows a bottom view of an 18" wide broom head with an integrated spray bar. The spray bar 33 has a plurality of spray jets centered to the broom head 30 and evenly spaced 1" apart. The spray jets have a hole diameter of approximately 3/64" and are angled at 35-degrees. The broom head 30 in this design also has two integrated turn valves 37 and 38 which control left and right edge water spray jets 31 and 32, respectively. The turn valves 37 and 38 can be manually actuated by the user with twist knobs 42 and 43 located on top of the broom head 45. The edge spray jets 31 and 32 discharge a focused volume of water from the edges of the broom head 30. The edge water spray jets are extremely effective and useful when cleaning surfaces next to walls, curbs or other vertical constructions. (For reference, the broom handle attachment point 34 is shown.) All of the spray jets are shown on the bottom of the broom head; however, alternatively, they can be positioned on the front of the head.

FIG. 7 also shows a top view of the broom head 30 indicating the location of the water channels 36, 39, 40 which supply jets 33, 31 and 32, respectively. A stem tube 44 receives water from a vinyl tube 46 and supplies the water to the water channels at 41.

Figure 8A:
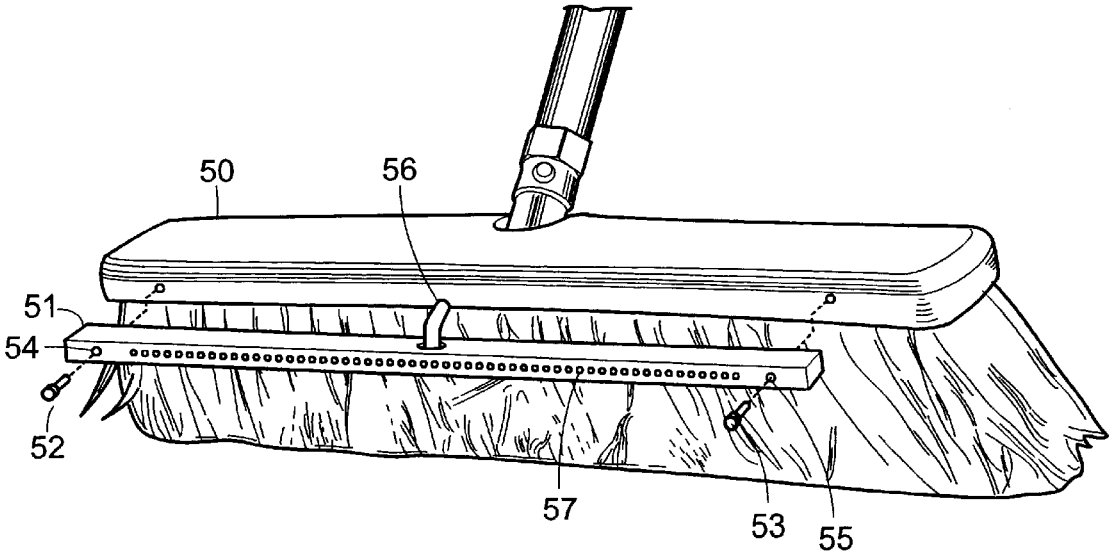
FIG 8A shows an embodiment of the invention with an alternative spray bar design.

FIG. 8A shows another spray bar design for an 18" wide broom head. The spray bar 51 is a ½" square tube, 16" long, which is attached to the broom head 50 where indicated via screws, nails or other attachment means 52 and 53, at 54 and 55 respectively. The spray bar 51 has a plurality of spray jets 57 centered to the spray bar 51 and evenly spaced ¾" apart. The spray jets 57 can be positioned on the bottom or front of the spray bar 51. The spray jets have a hole diameter of approximately 3/64" and are angled at 35-degrees. Vinyl tubing from the valve can be attached at 56.

Figure 8B:
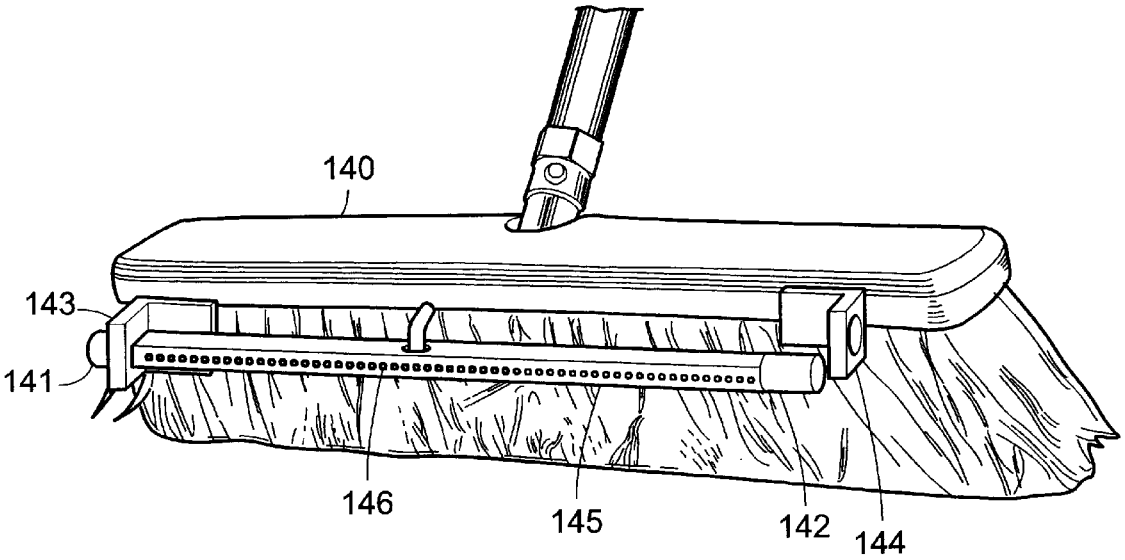
FIG. 8B shows an embodiment of the invention with another alternative spray bar design, including attachment of the spray bar with brackets.

FIG. 8B shows a similar spray bar design as the upper portion except that the spray bar is attached via brackets. The spray bar 145 has rounded ends 141 and 142 which are placed through the bracket holes at 143 and 144, respectively. The brackets are attached to the broom head 140 where indicated. The brackets 143 and 144 could be a molded on the front or bottom front of broom head 140. The bracket holes at 143 and are made such that the spray bar 145 is held firmly. The advantage to this design is that it allows the user to change the pitch of the water jet spray by manually rotating the spray bar 145. This design also shows slotted water spray jets 146. The slotted jets 146 help spread the water force horizontally and more uniformly in front of the broom head 140. The slotted spray jets 146 can be positioned on the bottom or front of the spray bar 145. The size and quantity of slotted spray jets should be sufficient to maintain adequate water pressure and force in front of the broom head 140. The use of slots, holes or other shapes of water jets practice the invention herein.

Figure 9A:
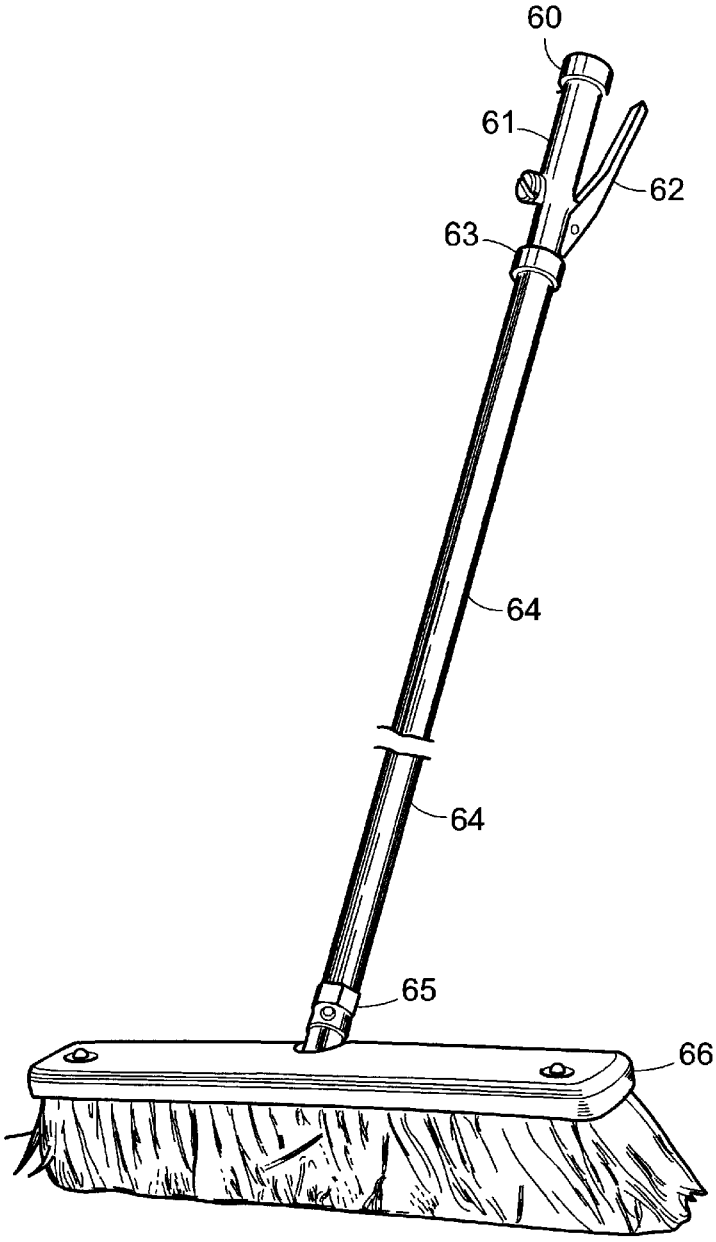
FIG. 9 shows an embodiment of the invention with a valve integrated onto a hollow broom handle
Figure 9B:
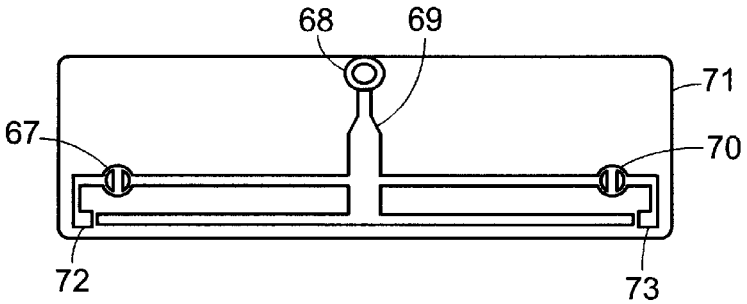
Figure 9C:
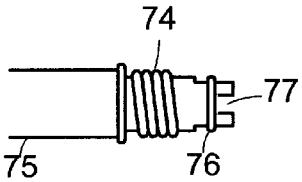

FIG. 9 shows the invention with a valve integrated onto a hollow broom handle. With this design no external tubing is required. A water hose is connected at 60 and the water is regulated via a spring-loaded valve 61. Lever 62 is supported by the fulcrum on the valve body 61. When the lever 62 is squeezed toward the valve body 61, water passes through the valve and into the hollow broom handle 64. The broom handle 64 screws into the broom head 66 at 65. The top water channel view 71 also shows where the broom handle end 74 attaches to the broom head at 68. Water is supplied from the broom handle 75 through the broom handle end hole 77 to the broom head water channel 69. A rubber o-ring type washer 76 seats inside of the broom handle attachment point 68 such that water, under pressure, can pass from the broom handle 64 to the broom head water channel 69 without leaking. The bottom view of the broom head is identical to 30 in FIG. 7 as previously described. They edge water spray jets, if so equipped, are also operated as previously described.

Figure 10A:
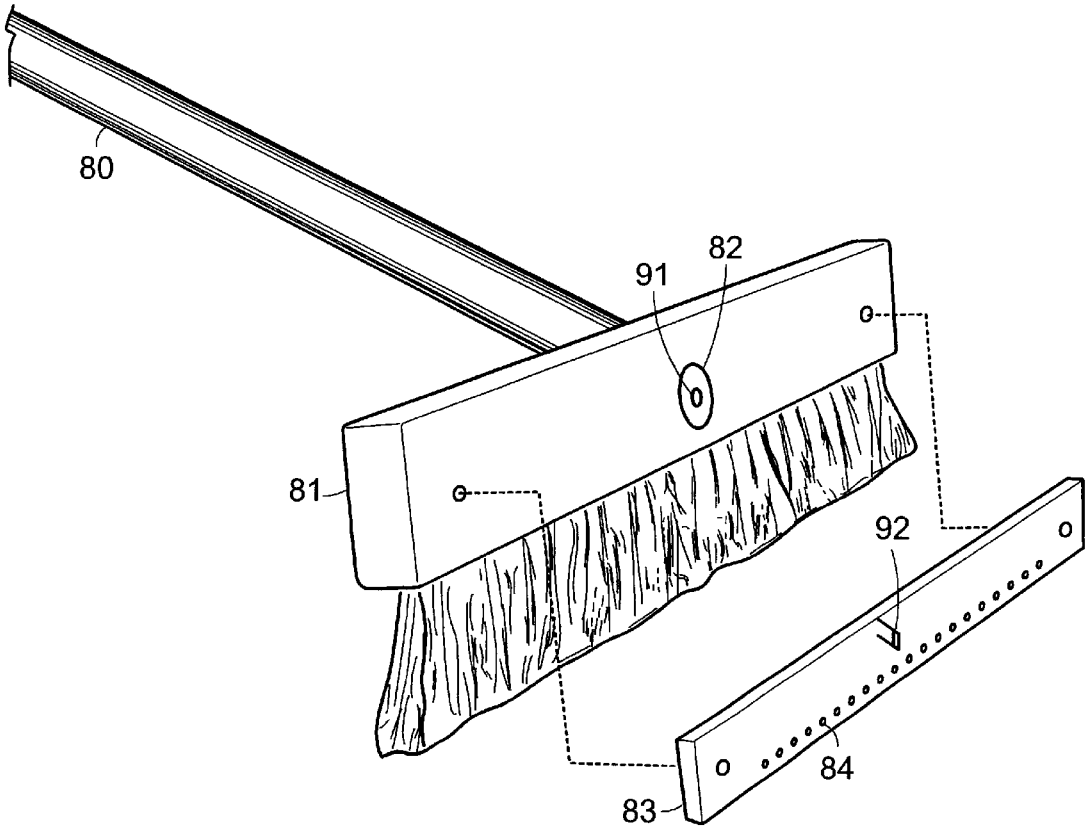
FIG. 10 shows an embodiment of the invention with a cost-effective broom head design.
Figure 10B:
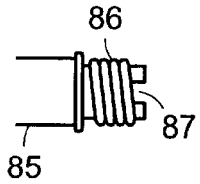
Figure 10C:
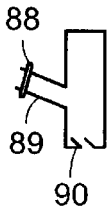
Figure 11:
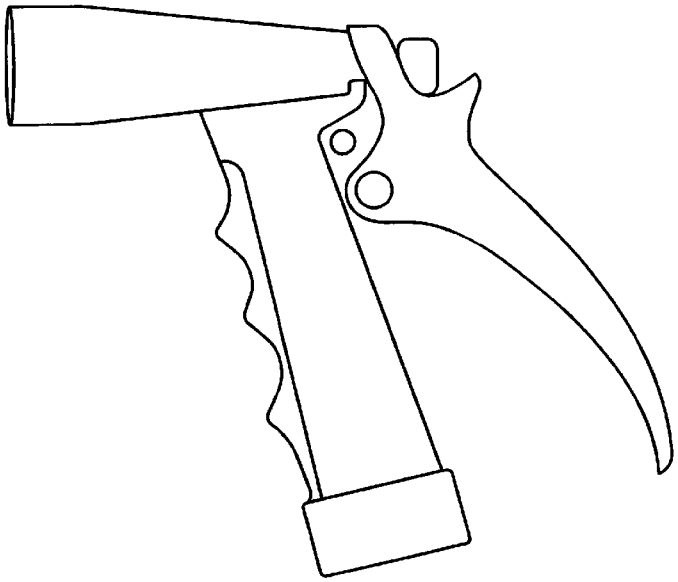
FIG. 11 shows an example of a hose nozzle.
Figure 12:
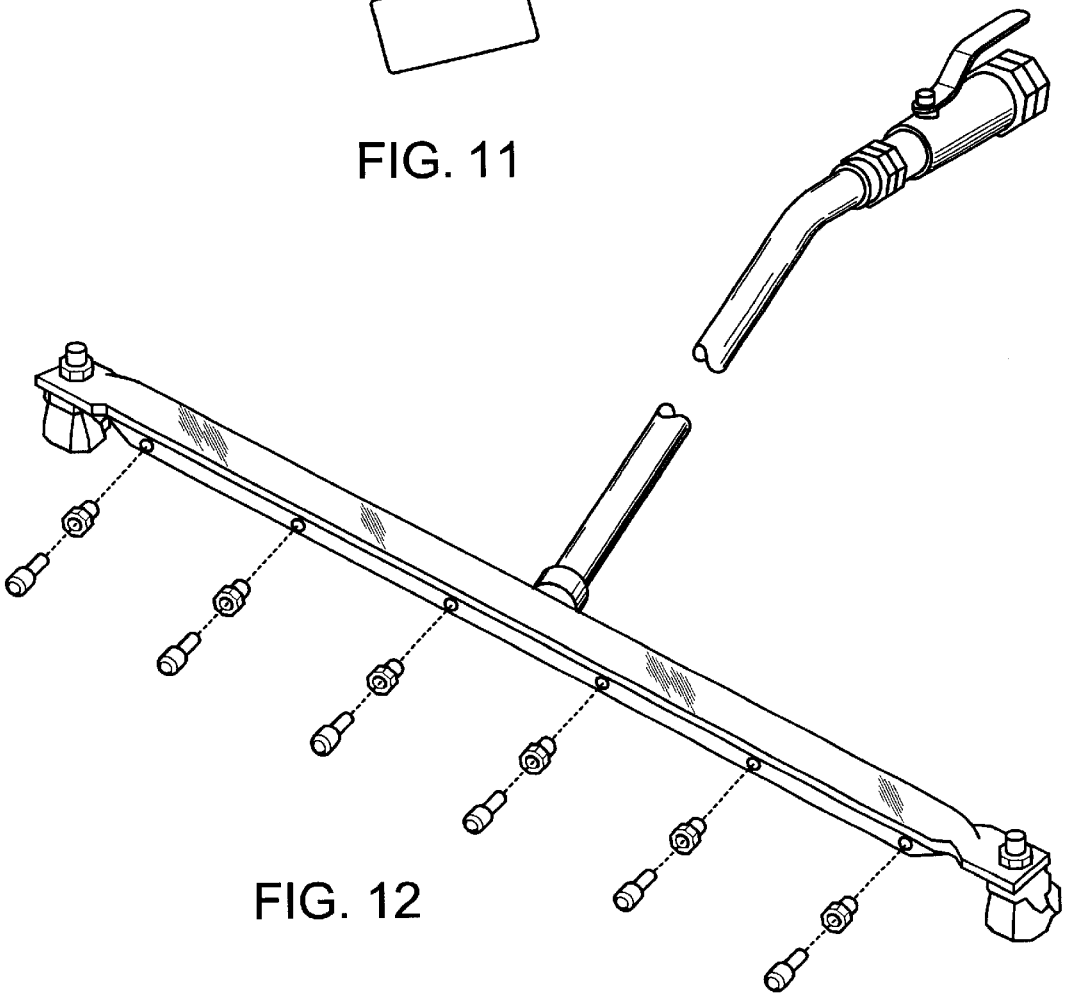
FIG. 12 depicts a conventional wheel-mounted spray system.
Figure 13:
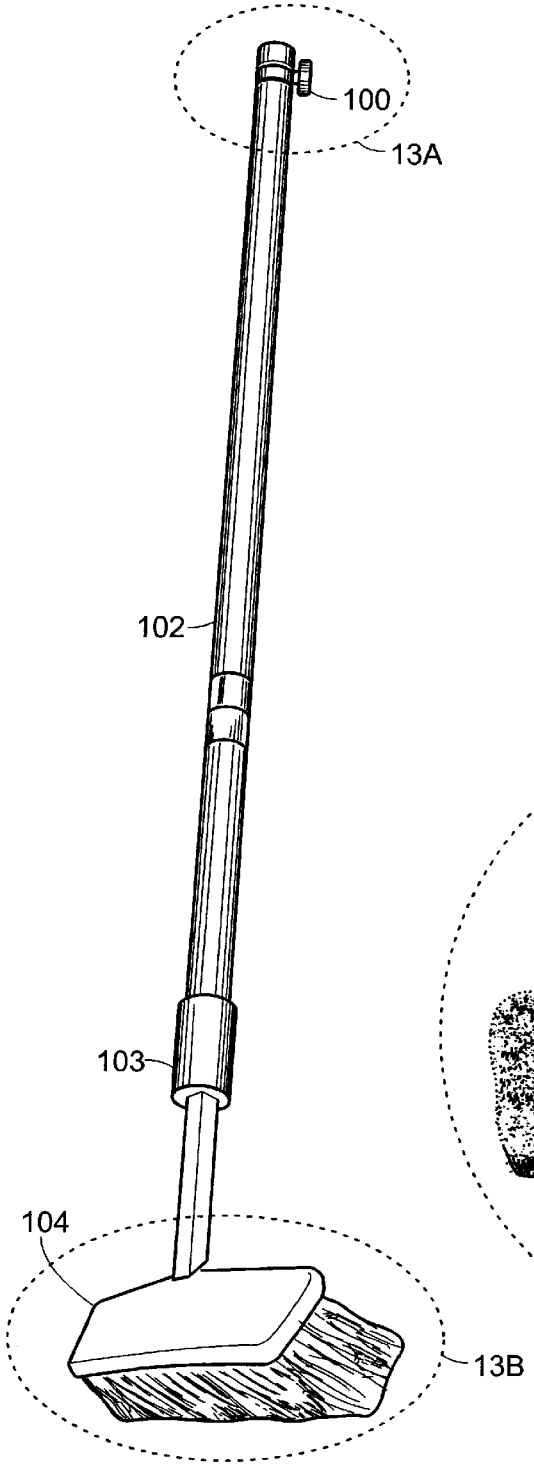
FIG. 13 shows a device combining brush and water technology.
Figure 13A:
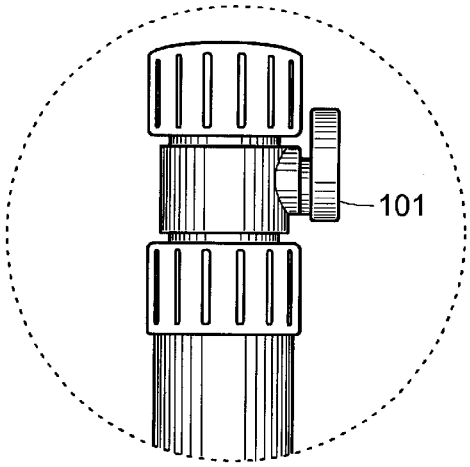
Figure 13B:
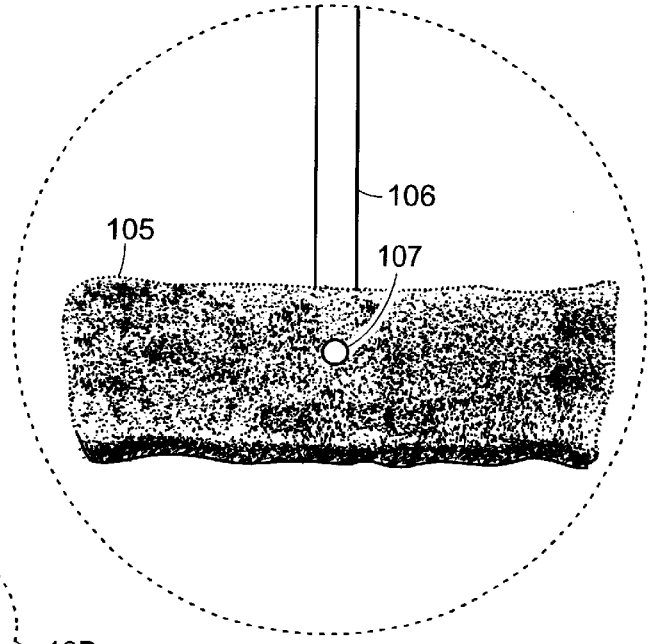

FIG. 10 shows the invention with a cost-effective broom head design. The broom head 81 measures approximately 18" Wide×⅞" Thick×4" High. (The height includes a bristle length of 2".) With this design, the broom handle 80 is attached to the broom head 81 with the tip of the broom handle end 86 emerging at the front face of the broom head 81 at 82. The spray bar 83 is mounted onto the broom head 81 by first positioning the spray bar stem tube 92 inside of the broom handle end hole 91, also shown at 87, and pushing the spray bar 83 flush onto the front face of the broom head 81. Screws, nails or other attachment means can be used where indicated to fix the spray bar 83 to the broom head 81. The side view of the spray bar 83 shows the spray bar stem tube 92 and a rubber o-ring type washer 88. When the spray bar stem tube is pushed into the broom handle end hole 91, the o-ring seats such that water does not leak as it passes from the broom handle 80 to the spray bar 83. An integrated valve and hollow broom handle of the type shown in FIG. 9 are used to supply water to the broom handle 80. The advantage of this design is that it does not require a specially molded broom head with water channels. The broom handle passes the water directly to the spray bar which can be made of very inexpensive plastic. The spray bar 83 has a plurality of spray jets 84 centered to the spray bar 83 and evenly spaced 1" apart. The spray jets have a hole diameter of approximately 3/64" and are angled at 35-degrees. The spray jets 84 can be positioned on the bottom or front of the spray bar 83.

The invention herein can sweep many floors surfaces clean with great efficiency. The invention can move a large amount of debris in a single pass. It is simple, inexpensive and easy to use.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A method of cleaning a surface, comprising:

a. providing a push broom having a broom head;

b. providing on the broom head a spray bar which is independently adjustable relative to the broom head, to change a spray angle to the ground, wherein the spray bar has an arcuate shape;

c. disposing a lever-controlled spring-loaded valve on the push broom that supplies fluid to the spray bar to enable the spray bar to spray fluid at a sufficient fluid pressure and force in front of and away from the broom head at an angle to the surface such that debris is lifted and carried forward of the broom head;

d. positioning the broom head behind debris to be swept;

e. enabling fluid flow through the lever-controlled spring-loaded valve while performing a sweeping stroke;

f. disabling fluid flow through the lever-controlled spring-loaded valve at the end of the sweeping stroke; and g. if sweeping is to continue, lifting and repositioning broom head, then repeating steps (d) through (f).

2. The method of claim 1, wherein in the step of disposing, the debris lifted and carried forward of the broom head includes sand, dirt, grime, grass, clippings, pine needles, saw dust, bark, mulch, small rocks and any combination thereof.

3. A push broom, comprising:

a broom handle and a broom head;

a spray bar, positioned on said broom head and independently adjustable relative to said broom head, for spraying fluid in front of and away from said head at various spray angles to the ground, wherein said spray bar has an arcuate shape; and a lever-controlled spring-loaded valve disposed on said broom handle, wherein said lever is supported by a fulcrum on said valve, and said valve is able to pulse the flow of fluid during sweeping strokes at a sufficient fluid pressure and force through a lumen to said spray bar such that debris is lifted and carried forward of said broom head.

4. The device of claim 3, where said valve is made to torsionally screw onto said handle.

5. The device of claim 3, where said valve is made integral to said handle.

6. The device of claim 3, where said lumen comprises a flexible tube that can be attached externally to said broom handle.

7. The device of claim 3, where said spray bar is mounted on said broom head.

8. The device of claim 3, where said spring-loaded valve is user-controlled.

9. The device of claim 3, where said valve has a spring-like action between the flow and no flow states.

10. The device of claim 3, wherein the debris lifted and carried forward of the broom head includes sand, dirt, grime, grass, clippings, pine needles, saw dust, bark, mulch, small rocks and any combination thereof.

11. A sweeping device, comprising:

a push broom head having a length; and a tubular spray bar positioned along part of the length of said broom head and independently adjustable to a plurality of spray angles, wherein said spray bar has an arcuate shape and wherein said spray bar projects fluid at a sufficient fluid pressure and force in front of and away from said broom head at an angle of said plurality of spray angles to the ground such that debris is lifted and carried forward of said broom head.

12. The device of claim 11, where said spray bar is configured with a plurality of fluid spray jets.

13. The device of claim 12, wherein the number of fluid spray jets is between ten and thirty.

14. The device of claim 11, where said spray bar is made to dispose on a common push broom.

15. The device of claim 11, wherein the debris lifted and carried forward of the broom head includes sand, dirt, grime, grass, clippings, pine needles, saw dust, bark, mulch, small rocks and any combination thereof.

16. A kit, comprising;

a lever-controlled spring-loaded valve, the valve having a fulcrum for supporting said lever;

a lumen, a spray bar having an arcuate shape, and at least one fastener for attaching the valve, the lumen, and the spray bar to a common push broom wherein the spray bar is independently adjustable relative to the head of the common push broom, thereby converting the common push broom into a broom that can project fluid at a sufficient fluid pressure and force at various spray angles to the ground such that debris is lifted and carried forward of said broom.

17. The kit claim 16, where said valve has a spring-like action between a flow state and a no flow state.

18. The kit of claim 16, wherein the debris lifted and carried forward of the broom head includes sand, dirt, grime, grass, clippings, pine needles, saw dust, bark, mulch, small rocks and any combination thereof.

* * * * *